US007471181B1

(12) United States Patent
MacLennan

(10) Patent No.: US 7,471,181 B1
(45) Date of Patent: Dec. 30, 2008

(54) METHODS AND APPARATUS FOR ELECTROMAGNETIC COMPONENTS

(75) Inventor: Grant MacLennan, Scottsdale, AZ (US)

(73) Assignee: CTM Magnetics, Inc., Tempe, AZ (US)

( * ) Notice: Subject to any disclaimer, the term of this patent is extended or adjusted under 35 U.S.C. 154(b) by 0 days.

(21) Appl. No.: 11/156,080

(22) Filed: Jun. 17, 2005

Related U.S. Application Data

(60) Provisional application No. 60/580,922, filed on Jun. 17, 2004.

(51) Int. Cl.
*H01F 27/24* (2006.01)

(52) U.S. Cl. ..... 336/229

(58) Field of Classification Search ..... 336/55, 336/65, 61, 83, 90–96, 173, 192, 229, 225, 336/200, 232–233
See application file for complete search history.

(56) References Cited

U.S. PATENT DOCUMENTS 3,374,452 A * 3/1968 Judd ..... 336/60
3,377,582 A * 4/1968 Rogers ..... 365/55
3,668,589 A 6/1972 Wilkinson
4,393,435 A * 7/1983 Petrina ..... 361/674
4,547,713 A 10/1985 Langley et al.
4,639,626 A 1/1987 McGee
4,710,667 A 12/1987 Whiteley
5,444,229 A 8/1995 Rudolph et al.
5,543,674 A 8/1996 Koehler
5,543,773 A * 8/1996 Evans et al. ..... 336/183
5,868,123 A 2/1999 Hasegawa et al.
6,154,109 A * 11/2000 Gold ..... 335/299
6,166,472 A 12/2000 Pinkerton et al.
6,648,990 B2 11/2003 Yoshizawa
6,897,718 B2 5/2005 Yoshida et al.

* cited by examiner

*Primary Examiner*—Tuyen T. Nguyen
(74) *Attorney, Agent, or Firm*—The Noblitt Group, PLLC

(57) ABSTRACT

Methods and apparatus for electromagnetic components comprise a core and a winding. The core and winding are configured to provide smaller and more effective electromagnetic components.

18 Claims, 8 Drawing Sheets

METHODS AND APPARATUS FOR ELECTROMAGNETIC COMPONENTS

CROSS-REFERENCE TO RELATED APPLICATIONS

This application claims the benefit of U.S. Provisional Patent Application No. 60/580,922, filed Jun. 17, 2004, and incorporates the disclosure of that application by reference.

FIELD OF THE INVENTION

The invention relates to methods and apparatus for electromagnetic components.

BACKGROUND OF THE INVENTION

Electromagnetic components are used in a variety of applications. In many industrial applications, electromagnetic components such as inductors are integral components such as inductors include cost, size, ability to dissipate heat, efficiency, and inductance capacity, as well as a variety of other considerations.

SUMMARY OF THE INVENTION

Methods and apparatus for electromagnetic components comprises a core and a winding. The core and winding are configured to provide smaller and more effective electromagnetic components.

BRIEF DESCRIPTION OF THE DRAWING

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in a different order are illustrated in the figures to help to improve understanding of embodiments of the present invention.

DETAILED DESCRIPTION OF EXEMPLARY EMBODIMENTS

The present invention is described partly in terms of functional components and various assembly and/or operating steps. Such functional components may be realized by any number of components configured to perform the specified functions and achieve the various results. For example, the present invention may employ various elements, materials, coils, cores, filters, supplies, loads, passive and active components, and the like, which may carry out a variety of functions. In addition, the present invention may be practiced in conjunction with any number of applications, environments, and passive circuit elements, and the systems and components described are merely exemplary applications for the invention. Further, the present invention may employ any number of conventional techniques for manufacturing, assembling, connecting, operating, and the like.

Figure 1A:
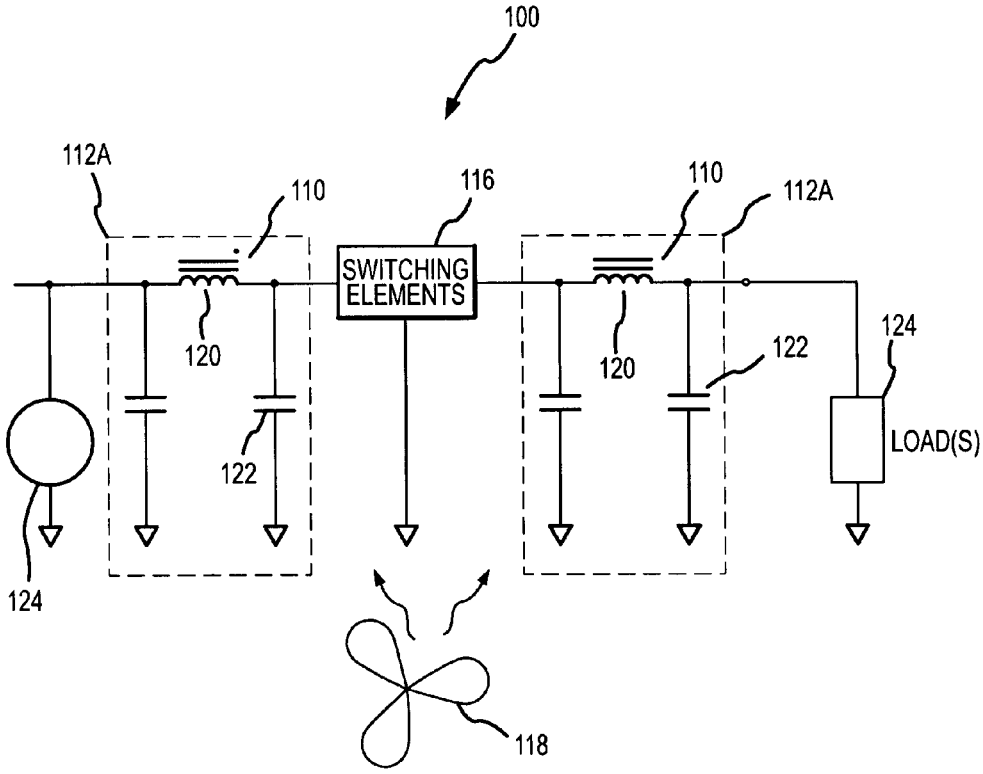
FIG. 1A-B are block diagrams of an electrical system according to various aspects of the present invention.
Figure 1B:
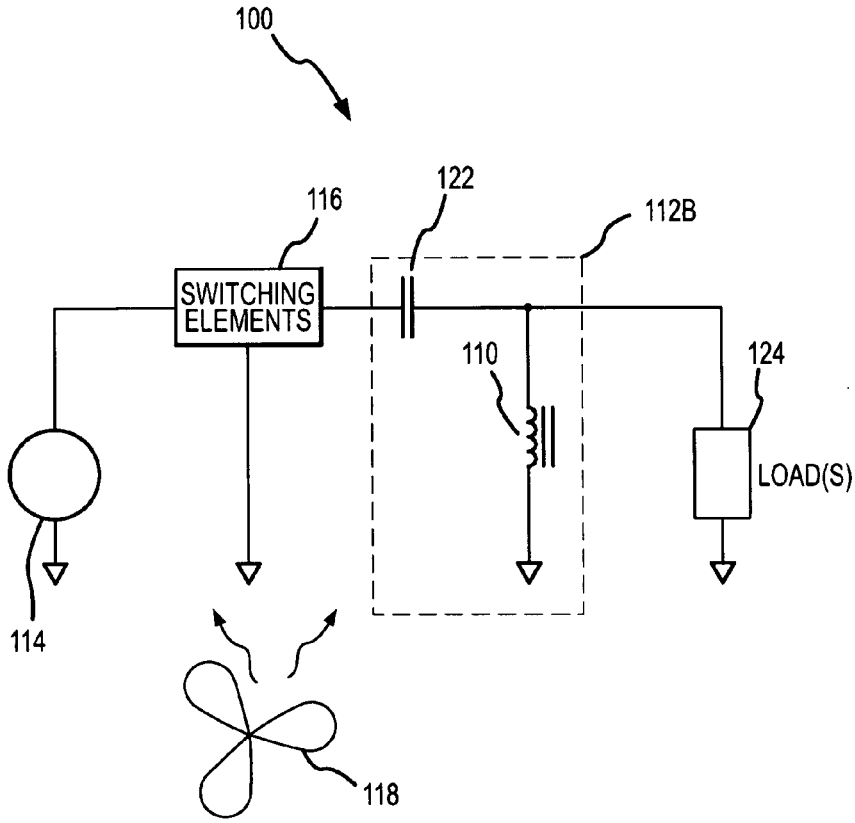

Referring now to FIGS. 1A-B, an electrical system 100 according to various aspects of the present invention may be implemented in conjunction with an electromagnetic component 110. The electromagnetic component 110 operates in conjunction with an electric current creating a magnetic field, such as with a transformer and/or an inductor. The electrical system 100 may comprise any system using the electromagnetic component 110. For example, in the present embodiment, the electrical system 100 comprises a power supply system having a filter circuit 112, such as a low pass filter 112A or a high pass filter 112B. The power supply may comprise any suitable power supply, such as a supply for medical equipment, an uninterruptible power supply, a backup power supply, a variable speed drive, an adjustable speed drive, high frequency inverters or converters or other suitable application or load 124. Electrical systems 100 comprising the electromagnetic component 110 may be adapted for any suitable application or environment, such as variable speed drive systems, uninterruptible power supplies and backup power systems (including systems using superconducting magnets, batteries, flywheel, Dynamic Voltage Ampere Reactive (DVAR) technology, and other systems), inverters and/or converters for renewable energy systems (including solar, fuel cell, wind turbine, hydrogen, natural gas turbines), hybrid energy vehicles, tractors, cranes, trucks and other machinery using fuel cells, batteries, hydrogen, wind, solar and other hybrid energy sources, regeneration drive systems for motors, motor testing regenerative systems and other inverter and/or converter applications.

For example, the electrical system 100 may be adapted for energy storage systems using DC or AC electricity configured backup or generate AC distributed power. Various aspects of the present invention are particularly suitable for high current applications, such as currents greater than about 10 A, particularly currents greater than 20 A, and more particularly currents greater than about 40 A, as well as to electrical systems exhibiting multiple combined signals, such as one or more pulse width modulated (PWM) higher frequency signals superimposed on a lower frequency waveform. For example, in many instances, a switching element may generate a PWM ripple on a main supply waveform.

In the present embodiment, the supply provides an alternating electrical current, such as a high current, to a load. The power supply system may include any other appropriate elements or systems, such as a voltage or current source 114, a switching system 116 comprising multiple integrated gate bipolar transistors (IGBTs), power field effect transistors (FET's), gate turn off devices (GTO's), silicon controlled rectifiers (SCR's), triacs, thyristors, and or any other electrically operated switches, and a circulating coolant system 118. The system can use various forms of modulation including pulse width modulation (PWM), resonant conversion, quasi-resonant conversion, phase modulation, or any other suitable form of modulation.

The filter circuit 112 is configured to filter selected components from the supply signal. The selected components may comprise any elements desired to be eliminated from the supply signal, such as noise and/or harmonic components and to reduce total harmonic distortion (THD). For example, in the present embodiment, the filter circuit 112 is configured to filter higher frequency harmonics, such as harmonics over 500 Hz, in the supply signal, such as harmonics induced by the IGBTs and or any other electrically operated switches. The filter circuit 112 may be configured in any suitable manner to filter the selected components. In the present embodiment, the filter circuit 112 comprises passive components including one or more electromagnetic components 110, such as an inductor-capacitor (LC) filter. In particular, the filter circuit 112 may comprise an inductor 120 and a capacitor 122. The values and configuration of the inductor 120 and the capacitor 122 may be selected according to any suitable criteria, such as to configure the filter circuit 112 for a selected cutoff frequency, which determines the frequencies of signal components to be filtered by the filter circuit 112.

Figure 2:
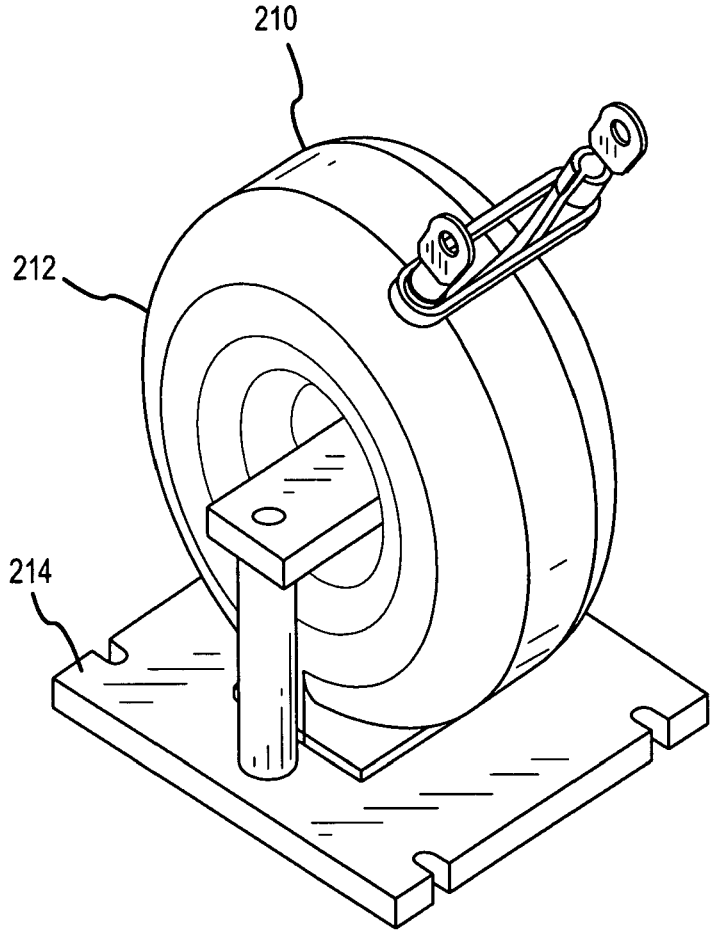
FIG. 2 is a perspective view of an inductor.

In one embodiment, the inductor 120 is configured to operate according to selected characteristics, such as in conjunction with high current without excessive heating or exceeding safety compliance temperature requirements. Referring to FIG. 2, the inductor 120 suitably comprises a core 210 and a winding 212. The inductor 210 may also include any additional elements or features, such as other items required in manufacturing. The winding 212 is wrapped around core 210. The core 210 provides mechanical support for the winding 212 and is characterized by a permeability for storing a magnetic field in response to current flowing through the winding 212. The core 210 and winding 212 are suitably disposed on or in a mount or housing 214 to support the core 210 in any suitable position and/or to conduct heat away from the core 210 and the winding 212.

The core 210 may comprise any suitable core 210 for providing the desired magnetic permeability and other characteristics, and may be selected according to any suitable criteria, such as permeability, availability, cost, operating characteristics in various environments, ability to withstand various conditions, heat generation, thermal aging, thermal impedance, thermal coefficient of expansion, curie temperature, tensile strength, and compression strength. In addition, the core 210 material is suitably configured to saturate only at relatively high magnetizing forces, similar to those of conventional laminated silicon steel.

For example, the core 210 may be configured to exhibit low core losses under various operating conditions, such as in response to a high frequency PWM or harmonic ripple, compared to conventional materials, like laminated silicon steel or conventional silicon iron steel designs. For example, the core may comprise a high inductance material or multiple materials to provide high inductance, smaller components, reduced emissions, and reduced core losses.

For example, in one exemplary system, the core 210 comprises a pressed powdered iron alloy material, such as a Material Mix No. -2 (dash two) from MicroMetals, Inc. of Anaheim, Calif. The core 210 suitably includes a distributed gap, which is introduced by the powdered material and bonding agent(s) of the core 210. The enormous number of very small magnetic gaps has the effect of reducing eddy current losses associated with gaps in a given magnetic path, thus reducing overall loss to heat associated with magnetic gaps as compared to silicon iron steel. Further, conventional inductor construction requires gaps in the magnetic path of the steel lamination, which are typically outside the coil construction and are, therefore, unshielded from emitting flux. The distributed gaps in the magnetic path of the present core 210 material are microscopic and substantially evenly distributed throughout the core 210. The flux energy at each microscopic gap tends to be almost infinitely lower than the energy at the large gap locations of the silicon iron steel, resulting in lower electromagnetic emissions.

Figure 7A:
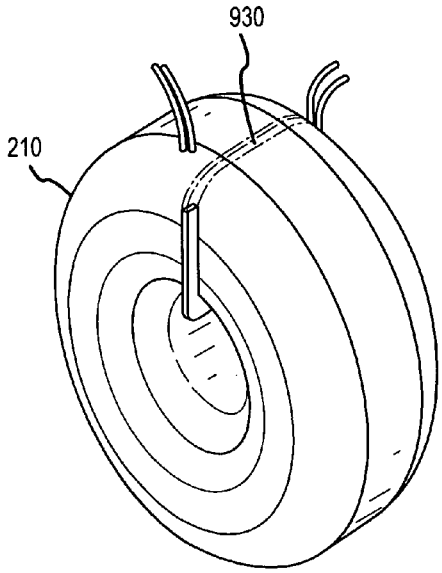
FIGS. 7A-B are a perspective view and a cross-sectional view of a hybrid core, respectively.
Figure 7B:
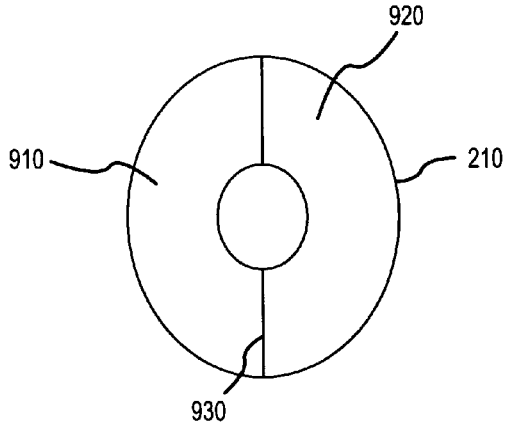

Alternatively, the core 210 may comprise a hybrid core comprising multiple materials. For example, referring to FIGS. 7A-B, the core 210 may comprise a first portion of a first material 910, such as the Micrometals -2 material, and a second portion of a higher permeability material 920 to provide higher inductances in a smaller package size by increasing the overall inductance rating. The core 210 may comprise any number of different materials, however, formed in any arrangement to achieve any desired result.

In the present embodiment, the core 210 comprises the Micrometals -2 material joined by a bonded joint 930 to the higher permeability material 920. Thus, the hybrid core 210 may provide a magnetic path having a hybrid inductance. The higher permeability material may provide a substantially increased inductance rating $A_L$ for the complete magnetic path of the core 210, as compared to a core 210 formed from a homogenous material. The increase in inductance rating allows the inductor 120 to store more energy in a given space. The core 210 in the present embodiment tends to exhibit reduced core loss compared to a core made entirely of the higher permeability material 920.

In addition, the hybrid effective $A_L$ (inductance rating) value energy tends to be forced through the magnetic path of the higher permeability section of the hybrid core 210. The lower inductance rating value is forced through the higher permeability material, which helps to reduce core losses at PWM ripple frequencies, as compared to a complete magnetic path with the higher permeability $A_L$ value. The hybrid core 210 and corresponding hybrid $A_L$ value tends to provide advantages over conventional silicon iron steel, for example in applications where the inductance desired cannot be met in using only Micrometals -2 material in the required volume of space.

Figure 3:
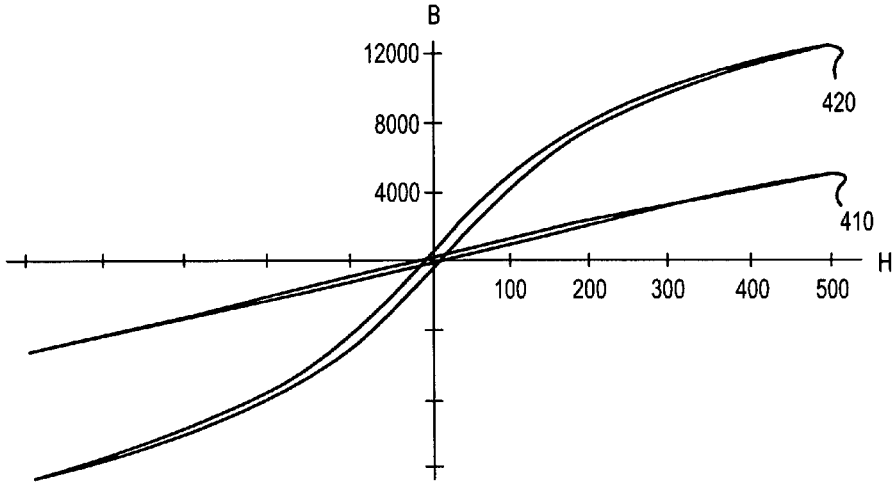
FIG. 3 is a BH curve for a Micrometals -2 material.

Furthermore, the core 210 material may provide a substantially linear flux density response over a range of magnetizing force strengths, thus producing a constant inductance value over the full operating range of the power system. For example, referring now to FIG. 3, for a core 210 comprising the Micrometals -2 material, the slope of the BH curve 410 has a substantially constant slope (permeability) compared to the slope of the -8 material BH curve 420, wherein the -8 material has a non-linear permeability in response to changing magnetizing force. In the present embodiment, the core 210 material comprises the Micrometals -2 material, which exhibits a substantially linear flux density response to magnetizing forces over a large range with very low residual flux (Br). The core 210 may provide inductance stability over a range of changing potential loads, from low load to full load to overload.

Figure 4A:
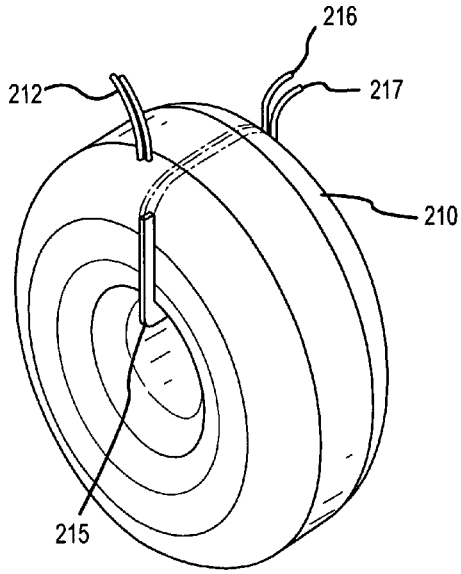
FIGS. 4A-B are diagrams of a multilayered winding configuration.
Figure 4B:
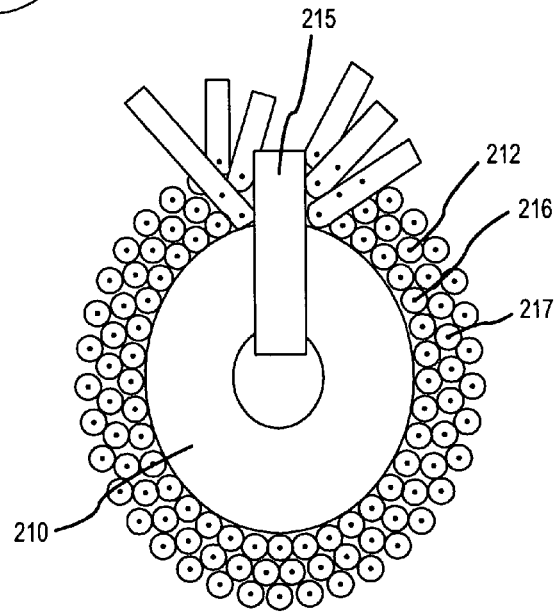
Figure 5A:
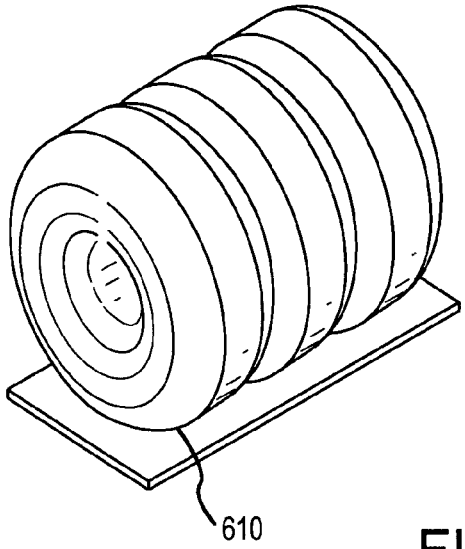
FIG. 5A-B are perspective views of a set of inductors according to various aspects of the present invention and a conventional inductor configuration, respectively.
Figure 5B:
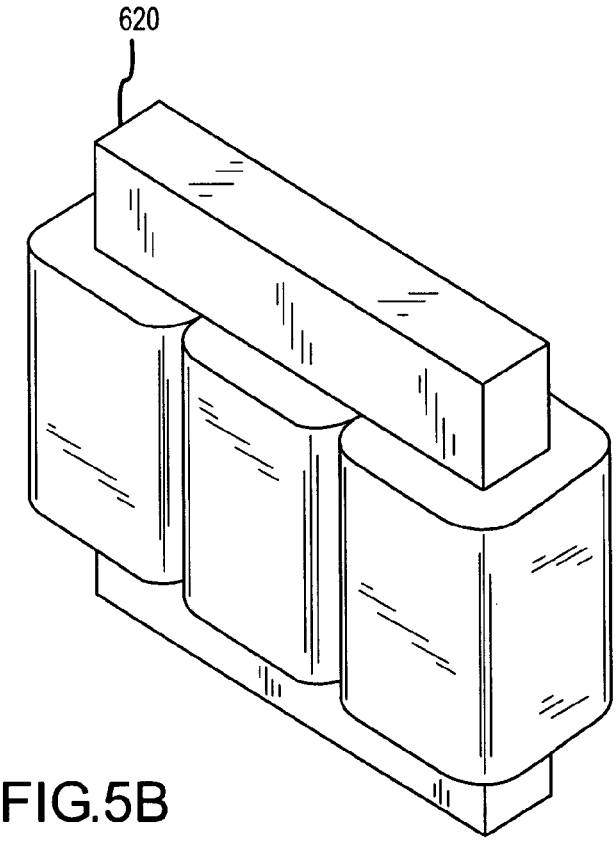

The core 210 may also be configured in any suitable manner to achieve any desired result, for example using any suitable shape and size. The configuration of the core 210 may also be selected to maximize the inductance rating $A_L$ of the core 210, enhance heat dissipation, reduce emissions, facilitate winding, and/or reduce residual capacitances. In one embodiment of the present invention, referring to FIGS. 4A-B, the core 210 comprises a toroid or other substantially circular shape and includes a spacer 215 comprised of air or other dielectric material. The toroid configuration normally exhibits relatively low electromagnetic emissions and provides significant surface area and a curving geometry for increased heat dissipation compared to other core shapes. For example, referring to FIG. 5B, a conventional silicon, iron lamination configuration 620 inhibits air flow around its center, and sharp corners likewise disrupt air flow.

In this configuration, the winding 212 nearly entirely covers the toroid core 210. Leakage flux is inhibited from exiting the toroid inductor 120, thus reducing EMI emissions. The windings 212 tend to act as a shield against such emissions. In addition, the soft radii in the geometry of the windings and the core material are less prone to leakage flux than conventional configurations.

Figure 6:
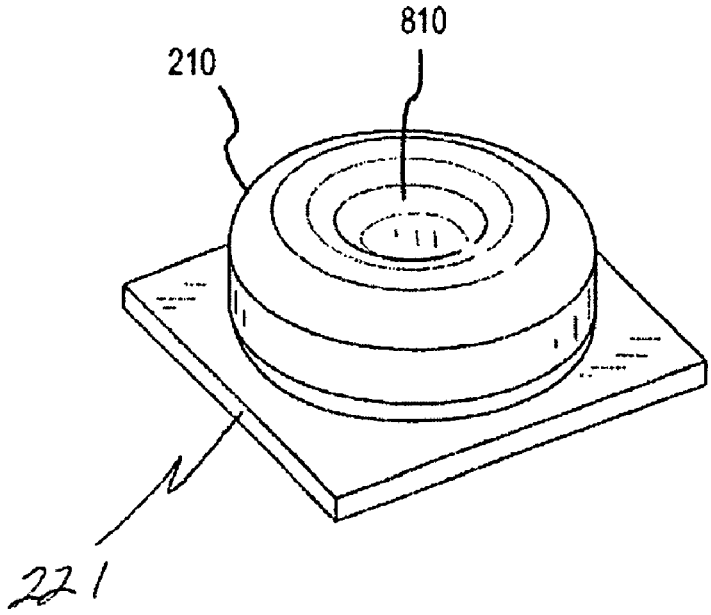
FIG. 6 is a diagram showing a sample inductor configuration.

The present toroid inductor geometry facilitates airflow to move through the inside diameter and around the outside diameter. In addition, the soft radii shape of the toroid promotes airflow. In addition, the toroid inductor 210 allows the system to use individual single phase toroids, which can be mounted anywhere inside a system cabinet or enclosure to further improve efficiency and reduce airflow restrictions, unlike the conventional configuration of FIG. 6B, in which air cannot easily flow through the center, around the sharp edges and over the larger bulk.

The configuration of the core 210 may also be suitably adapted to operate in a variety of conditions, such as low airflow environments and outdoor use. In one embodiment of the present invention, referring to FIG. 6, the inductor 120 comprises a core 210 in a toroid shape suitably supported by a housing or mount 214. The core 210 is mounted to the housing 214 in such a manner to prevent the inductor 120 from shorting to ground, such as, for example, encasing the inductor 120 in a thermally conductive dielectric material and using non-metallic connectors. This configuration allows the inductor 120 to operate in environments such as the outdoors as well as to conform to various manufacturing standards for various environments such as, for example, those released by NEMA.

The large increase in the available surface area of the toroid inductor invention gives the system improved performance in low airflow environments when compared, for example, to conventional silicon iron steel. Referring again to FIG. 6, when mounted in a low profile, low airflow configuration, the toroid inductor promotes heat radiation. The heat generating components may also be located proximate to the heat radiating elements, unlike the considerably larger conventional silicon iron technology, which tends to have many of its hottest components disposed away from a heat sink. The toroid configuration provides an efficient transfer of thermal energy, supplying improved heat dissipation characteristics in low airflow environments and facilitating use of smaller cooling elements and heat sinks.

A thermally conductive compound applied to the inductor 120 may increase the thermal transfer efficiency from the windings 212 and core 210 to a heat sink device cooled by cooling element 118. The thermally conductive compound can be used to fully encapsulate the inductor or transformer and seal it sufficiently to pass the NEMA 4 submersion test described in UL 50 for outdoor use. This allows the unit to stand alone, for example on the outside of a system cabinet. Consequently, the component may be suitable for use in NEMA 4 outdoor system applications. The inductor 120 resists shorting due to the "floating" (ungrounded) core of the toroid construction. In addition, outdoor models may be configured for the NEMA 4 submersion test in UL 50, for example by vertically mounting the toroid inductor with non-metallic machined parts.

In addition, the core 210 may be configured in any suitable manner to achieve results such as to optimize size and/or weight, and maximize the inductance rating ($A_L$) of the core 210. In the present embodiment, for example, the toroid configuration of the core 210 allows for considerably less material of the winding 212 to be used than conventional designs, such as the conventional configuration of FIG. 5B. Furthermore, the smaller size of the core 210 and smaller amount of the winding 212 required for the toroid design results in a reduction in the overall size and weight of the inductor 120. The size of the toroid may also be configured to accommodate a selected number of turns in the winding. In the present embodiment, for example, the toroid design of the core 210 also allows more turns of the winding 212 than conventional designs such as the conventional component 620 to maximize the inductance rating ($A_L$) of the core 210.

The winding 212 comprises a conductor for conducting electrical current through the inductor. The winding 212 may comprise any suitable material for conducting current, such as conventional wire, foil, twisted cables, and the like formed of copper, aluminum, gold, silver, or other electrically conductive material or alloy at any temperature. In the present embodiment, the winding 212 comprises copper magnet wire wound around the core 210 in one or more layers.

The magnet wire may be round wire to expose greater area for cooling the core 210. Alternatively, the magnet wire may comprise rectangular wire or other regulator geometry to facilitate more windings 212 within a particular area. Additionally, the winding 212 may further comprise any other suitable material such as non-conductive material in any configuration. The type and configuration of winding 212 and the number of turns and layers may be selected according to the desired characteristics of the inductor 120. In one embodiment of the present invention, for example, the winding 212 comprises round magnet wire wound in multiple layers to reduce the energy stored by the inductor 120.

The winding 212 may be configured in any suitable manner. For example, the winding 212 may such as comprise one or more strands of conductor and in one or more layers. In one embodiment of the present invention, referring to FIG. 4B, the winding 212 comprises a first conductor 216 and a second conductor 217, wherein the second conductor 217 is wound on top of the first conductor 216 to minimize the voltage between the two conductors. The winding 212 is suitably wrapped around the smallest diameter of the core 210 in a spiral and or any other suitable pattern. In one embodiment, the winding 212 comprises multiple strands of wire, such as twenty strands of 12 AWG (American Wire Gauge) wire, each of which is wrapped around the smallest diameter of the core 210 individually and co-terminated with the other strands such that all twenty strands are wired in parallel. The winding 212 may be configured to achieve any to achieve any desired results. In the present embodiment, for example, the toroid configuration of the core 210 is substantially encased by the winding 212, preventing magnetic flux leakage and reducing electromagnetic interference (EMI) emissions from the inductor 120.

For core 210 materials having low permeability, such as the Micrometals -2 material, the inductor may require additional turns compared to higher permeability cores. In some embodiments, the filter circuit 112 may include multiple inductors configured in parallel and/or series to provide the desired inductance characteristics. Multiple inductors may also be used in other applications, such as to operate in conjunction with a poly-phase power system where one inductor handles each phase.

The toroidal shape allows considerably less cross sectional area of conductor 212 for a given current rating. Because the conductor 212 is on the outside of the core, with virtually 100% of its surface area exposed, it can be heavily controlled by cooling elements 118 and high thermal transfer compound integrated with a heat sink. The reduction in required conductor size reduces the overall size and weight of the inductor 120, transformer, or other electromagnetic component.

The reduction in necessary conductor 212 size allows the toroid configuration to use more turns to obtain the desired inductance for the filter circuit 112. Inductance is the product of the inductance rating and the square of the turns. Therefore, additional turns achieve desired inductance. Increasing turns due to reduced cross sectional conductor requirements facilitate achieving a desired inductance in a reduced package weight and size.

In addition, the present configuration using round magnet wire wound one layer on top of another layer provides a low, potentially nearly zero, effective turn-to-turn voltage. The energy stored, therefore, is very low as well. Energy stored corresponds to the capacitance times the square of the voltage applied. The energy stored in reduced by the square of the turn to turn voltage reduction, thus reducing energy stored in the present configuration. Further, the self resonant frequency (SRF) is inversely related to energy stored and is a simple test to confirm low energy stored construction. Toroid configurations tend to exhibit higher SRFs than conventional configurations and can sometimes allow the system to operate with smaller value capacitors in a given filter circuit.

The housing 214 may comprise any system, device, or plurality of devices and systems suitably adapted to support the core in any position. In addition, the housing 214 may be configured in any suitable manner to achieve any suitable result, such as to direct heat away from the core 210, to protect the core 210 from the elements, or for any other purpose. The housing 214 may comprise any suitable material.

For example, the housing 214 may comprise a heat conducting material connected to a heat sink 221. The housing 214 is suitably configured to minimize its interference with the winding 212 and improve heat radiation characteristics. The housing 214 and the inductor 120 may be configured to operate in a variety of conditions. In one embodiment of the present invention, the electromagnetic component 110 may be encased in a thermally conductive compound that acts to both aid in heat dissipation and provide protection from the elements, for example in accordance with standards released by the National Electrical Manufacturers Association (NEMA). In alternative embodiments, the housing 214 comprises a thermal transfer medium, such as a thermally conductive material abutting the inductor 120 to transfer heat away from the inductor 120, which may be thermally connected to a heat sink. The housing 214 may be configured in any suitable manner to support and/or transfer heat away from the inductor 120.

In operation, an electrical system 100 according to various aspects of the present invention supplies power to the load 124 by generating power via the source 114. The power signal is provided to the switching system 116, for example to regulate the magnitude of the power signal provided to the load 124. The switching system 116 or other sources may, however, introduce harmonics or other noise into the power signal, which may damage or disrupt the load or cause electromagnetic interference (EMI).

The filter circuit 112 filters unwanted components from the power signal, such as harmonics and noise. The power signal is provided to the inductor 120, which establishes a current in the winding 212. In the present embodiment, the core 210 exhibits low core losses in response to high frequencies as compared to silicon iron steel. Consequently, the inductor 120 generates less heat in response to the harmonics and other higher frequency noise in the power signal. In addition, the exposed surface of the core 210 between the turns of the winding 212 facilitates a lowering of the inductor to air thermal resistance thus reducing heat dissipation and increasing efficiency, especially in conjunction with the cooling system 118. The low losses of the core 210 material reduce the overall power requirements of the inductor 120, thus reducing the necessary copper density for the winding 212. Moreover, because an inductor according to various aspects of the present invention can accommodate higher frequencies without overheating, as well as higher currents without saturating, the core 210 does not need to be enlarged to reduce heat generation or avoid saturation. Consequently, the inductor 120 may be relatively small and light to achieve the same or better performance and other operating characteristics.

The particular implementations shown and described are illustrative of the invention and its best mode and are not intended to otherwise limit the scope of the present invention in any way. Indeed, for the sake of brevity, conventional manufacturing, connection, preparation, and other functional aspects of the system may not be described in detail. Furthermore, the connecting lines shown in the various figures are intended to represent exemplary functional relationships and/or physical couplings between the various elements. Many alternative or additional functional relationships or physical connections may be present in a practical system.

In the foregoing description, the invention has been described with reference to specific exemplary embodiments; however, it will be appreciated that various modifications and changes may be made without departing from the scope of the present invention as set forth herein. The description and figures are to be regarded in an illustrative manner, rather than a restrictive one and all such modifications are intended to be included within the scope of the present invention. Accordingly, the scope of the invention should be determined by the generic embodiments described herein and their legal equivalents rather than by merely the specific examples described above. For example, the steps recited in any method or process embodiment may be executed in any order and are not limited to the explicit order presented in the specific examples. Additionally, the components and/or elements recited in any apparatus embodiment may be assembled or otherwise operationally configured in a variety of permutations to produce substantially the same result as the present invention and are accordingly not limited to the specific configuration recited in the specific examples.

Benefits, other advantages and solutions to problems have been described above with regard to particular embodiments; however, any benefit, advantage, solution to problems or any element that may cause any particular benefit, advantage to solution to occur or to become more pronounced are not to be construed as critical, required or essential features or components.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The present invention has been described above with reference to a preferred embodiment. However, changes and modifications may be made to the preferred embodiment without departing from the scope of the present invention. These and other changes or modifications are intended to be included within the scope of the present invention, as expressed in the following claims.

The invention claimed is:

1. An electrical system, comprising:

an inductor, comprising:

a toroidal core comprising a first core material, wherein the first core material:

defines a distributed gap;

comprises a magnetic field of less than four thousand Gauss at two hundred Oersteds; and exhibits low permeability and low core losses at frequencies above 500 Hz; and a winding, comprising:

a first terminal and a second terminal; and multiple strands of wire wrapped around the core, wherein each of at least two of the multiple strands of wire connect in parallel the first terminal and the second terminal.

2. The electrical system of claim 1, wherein the first core material comprises a pressed powdered iron alloy.

3. The electrical system of claim 1, wherein the winding comprises substantially round insulated copper wire.

4. The electrical system of claim 1, further comprising a heat sink thermally connected to at least one of the core and the winding.

5. The electrical system of claim 4, wherein the heat sink comprises a thermally conductive compound.

6. The electrical system of claim 1, further comprising a cooling element disposed adjacent the winding.

7. The electrical system of claim 1, further comprising a housing at least partially enclosing the winding, wherein the housing comprises a heat conductive material attached to the winding to conduct heat away from at least one of the core and the winding.

8. The electrical system of claim 1, wherein the multiple strands of wire comprise a first strand of wire wrapped around the core and a second strand of wire wrapped around the core and the first strand of wire.

9. The electrical system of claim 1, further comprising a dielectric spacer positioned between the first terminal and the second terminal.

10. The electrical system of claim 1, wherein the core comprises a low permeability material.

11. The electrical system of claim 1, further comprising a supply configured to supply a current at at least 40 amperes (RMS) and having a frequency component of at least 500 Hz, wherein the inductor is connected to the supply to receive the current.

12. The electrical system of claim 11, wherein the supply is configured to supply a current at at least 400 amperes (RMS).

13. The electrical system of claim 1, said core material comprising a substantially constant permeability slope over a range of −400 to +400 Oersteds.

14. The electrical system of claim 1, said core material comprising a residual flux of about 36 Gauss.

15. The electrical system of claim 1, further comprising:

a hybrid core, wherein said hybrid core comprises:

a second core material; and a bonded joint bonding said second core material to said first core material, wherein said hybrid core reduces core loss, increases inductance rating, and stores more energy relative to a non-hybrid core.

16. The electrical system of claim 1, wherein said toroidal core comprises multiple individual phase toroids operating in conjunction with a poly-phase power system, wherein each of said multiple individual phase toroids handles a corresponding phase of the poly-phase power system.

17. The electrical system of claim 1, wherein each of said multiple strands of wire comprise corresponding starts and ends, wherein said starts of said multiple strands of wire co-terminate and said ends of said multiple strands of wire co-terminate.

18. The electrical system of claim 1, wherein a first strand of said multiple strands of wire and a second strand of wire of said multiple strands of wire run in parallel along said winding.

* * * * *